US011174697B2

(12) United States Patent
Woie et al.

(10) Patent No.: US 11,174,697 B2
(45) Date of Patent: Nov. 16, 2021

(54) CONDUCTORLESS SUBSEA WELL

(71) Applicant: ConocoPhillips Company, Houston, TX (US)

(72) Inventors: Rune Woie, Houston, TX (US); Tarald Husevaag Gaup, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 16/810,803

(22) Filed: Mar. 5, 2020

(65) Prior Publication Data

US 2020/0284117 A1 Sep. 10, 2020

Related U.S. Application Data

(60) Provisional application No. 62/815,231, filed on Mar. 7, 2019.

(51) Int. Cl.
*E21B 33/043* (2006.01)
*E21B 33/076* (2006.01)
*E21B 7/12* (2006.01)

(52) U.S. Cl.
CPC ..... *E21B 33/043* (2013.01); *E21B 7/12* (2013.01); *E21B 33/076* (2013.01)

(58) Field of Classification Search
CPC ..... E21B 33/043; E21B 33/076; E21B 7/12; E21B 41/08
See application file for complete search history.

(56) References Cited

U.S. PATENT DOCUMENTS 3,754,607 A * 8/1973 Van Daalen ..... E21B 7/124 175/7
4,279,542 A 7/1981 Lewis, Jr.
4,658,903 A 4/1987 Tateishi
4,815,894 A 3/1989 Copson
5,380,130 A * 1/1995 Kessler ..... E02B 17/00 166/241.1
5,526,882 A * 6/1996 Parks ..... E21B 43/017 166/339
8,544,550 B2 * 10/2013 Willoughby ..... E21B 33/00 166/360
9,903,172 B2 2/2018 Hansen

FOREIGN PATENT DOCUMENTS

GB 2527386 A * 12/2015 ..... E21B 33/037

OTHER PUBLICATIONS

International Search Report and Written Opinion for International Application No. PCT/US2020/021277, dated Jun. 4, 2020, 10 pages.

* cited by examiner

*Primary Examiner* — James G Sayre
(74) *Attorney, Agent, or Firm* — Polsinelli PC

(57) ABSTRACT

A system and method for creating a subsea well for the production or injection of hydrocarbons, fluids, or gases which can include installing an assembly having a subsea template and at least one conductor housing installed in a slot in the template. A drill string can be passed through the at least one conductor housing and drill directly into the seafloor to create a first bore associated with the slot in the template. The bore can be of a diameter suitable for a surface casing and the surface casing can be passed through the conductor housing and into the bore.

20 Claims, 3 Drawing Sheets

CONDUCTORLESS SUBSEA WELL

CROSS-REFERENCE TO RELATED APPLICATIONS

The application claims the benefit of U.S. Provisional Application No. 62/815,231, filed Mar. 7, 2019, the contents of which is incorporated by reference herein in their entirety.

BACKGROUND

1. Field of the Invention

The present inventive concept relates generally to a system and method for drilling a subsea well and/or to a subsea production assembly for oil and gas wellbore drilling

2. Description of Related Art

Oil and gas wells formed in a subsea environment require a subsea template (i.e. a drilling guide) installed on the floor the surface of the earth (i.e. seabed or seafloor). The subsea template requires a drill string implemented for formation of an initial portion of a borehole, removal of the drill string, and insertion of a conductor housing and a conductor into the drilling guide and the initial portion of the borehole. The drill string must then be reinserted for formation of the remaining portion of the borehole having a smaller diameter than the initial portion of the borehole. This conventional process is time consuming, inefficient, and expensive, as the template assembly is required to be assembled hundreds or thousands of meters underwater on the seafloor in unknown, difficult environments that are subject to rapid change and present dangerous conditions to workers and equipment.

SUMMARY

The present inventive concept provides a system and method to allow formation of a borehole in a subsea environment with a drilling template either having a conductor housing installed prior to formation the borehole and/or having no conductor housing, thus allowing continuous formation of the borehole for the surface casing. The system and method generally includes creating a subsea well for production or injection of hydrocarbons, liquids or gases. A subsea template can be installed on a seafloor and, optionally, have at least one conductor housing installed within at least one slot formed in the template. A drill string can be passed through the at least one conductor housing and/or directly through the slot in the event that the conductor housing is omitted, thereby allowing in either case drilling directly into the seafloor to create a first bore associated with the slot in the template. The bore can be of a diameter suitable for a surface casing. A surface casing can be passed through the conductor housing and into the bore or, in the alternative, the surface casing may be passed directly though the template slot if the conductor housing is omitted.

The conductor housing, if present, can be assembled in the subsea template onshore prior to installing the assembly on the seafloor. The template can be installed on the seafloor and in some instances the conductor housing can be installed in the template slot when the template is on the seafloor.

The surface casing can be welded to a wellhead housing. The wellhead housing can be installed within the conductor housing and/or directly. The wellhead housing can be installed within the template slot in instances in which the conductor housing is omitted altogether. The surface casing can have a diameter and wall thickness operable to provide sufficient strength together with the wellhead housing to withstand expected axial, bending and/or fatigue loads acting on the conductor housing during installation and/or during the anticipated life of the well.

The surface casing can have an outer diameter between 40 centimeters (cm) and 66 cm.

The template can have a plurality of template slots, including, but not limited to, between 2 and 10. In other instances, template can have a plurality of template slots including, but not limited to, between 2 and 6.

The assembly can have a plurality of conductor housings, such as between 1 and 10, optionally between 2 and 6, mounted to the template. Each of the plurality of conductor housings can have a corresponding plurality of template slots, each conductor housing being associated with a respective slot in the template. One or more axial, lateral, circumferential, and/or associated bending loads acting on one conductor housing can be transferred to another of the plurality of conductor housings through the structure of the plurality of slots and the template. The one or more loads can be transferred from one conductor housing to another conductor housing through the template slot, and/or through conductor housing to the wellhead housing and the connected surface casing installed within the conductor housing and passing the one or more loads into the seafloor.

The one or more loads can be generated by external wind and/or waves acting on a drilling riser that is installed on the wellhead housing for continued drilling the well after installation of the conductor housing and the wellhead housing with respective conductor and surface casing. The drilling riser can be implemented to allow fluids containing drill cuttings to be circulated out of the well and/or to control well pressures by using well fluids with densities that can be higher than seawater density. For the riser to survive lateral and bending stress and fatigue due to weather conditions, but also the fluid densities and temperatures, the riser can be put in tension from the surface. Optimum riser tension can be calculated and applied to the riser to avoid riser collapse, burst, bending, and/or survival in critical load conditions for the riser, and allow loads to be transferred to the active wellhead with surface casing. Excessive loads may cause catastrophic stress or fatigue failure of the connection between surface casing and wellhead housing.

A subsea production assembly can include a subsea template having at least one slot formed therein and a conductor housing can be installed in the slot. The conductor housing does not have a conductor welded or otherwise joined thereto. The assembly can be suitable for installation on the seafloor as an integral unit. The template can include a plurality of conductor housings, such as between 2 and 10, optionally 2 to 4, each conductor housing of the plurality of conductor housings can be installed in a respective slot of a plurality of slots in the template. The tolerance fit between each template slot and the respective conductor housing can be between 0.2 millimeters (mm) and 1.0 mm, preferably between 0.4 and 0.8 mm, e.g. between 0.5 and 0.7 mm.

The outer diameter of the conductor housing can be between 96 and 152 cm, preferably between 101 cm and 127 cm, e.g. between 107 and 117 cm.

The assembly can include a bracing structure provided between one or more slots in the template to allow a lateral load on one slot to be shared with one or more other slots of the template.

BRIEF DESCRIPTION OF THE DRAWINGS

The novel features of the disclosure are set forth with particularity in the appended claims. A better understanding of the features and advantages of the present inventive concept will be obtained by reference to the following detailed description that sets forth illustrative examples, in which the principles of the disclosure are utilized, and the accompanying drawings of which:

DETAILED DESCRIPTION

Figure 1:
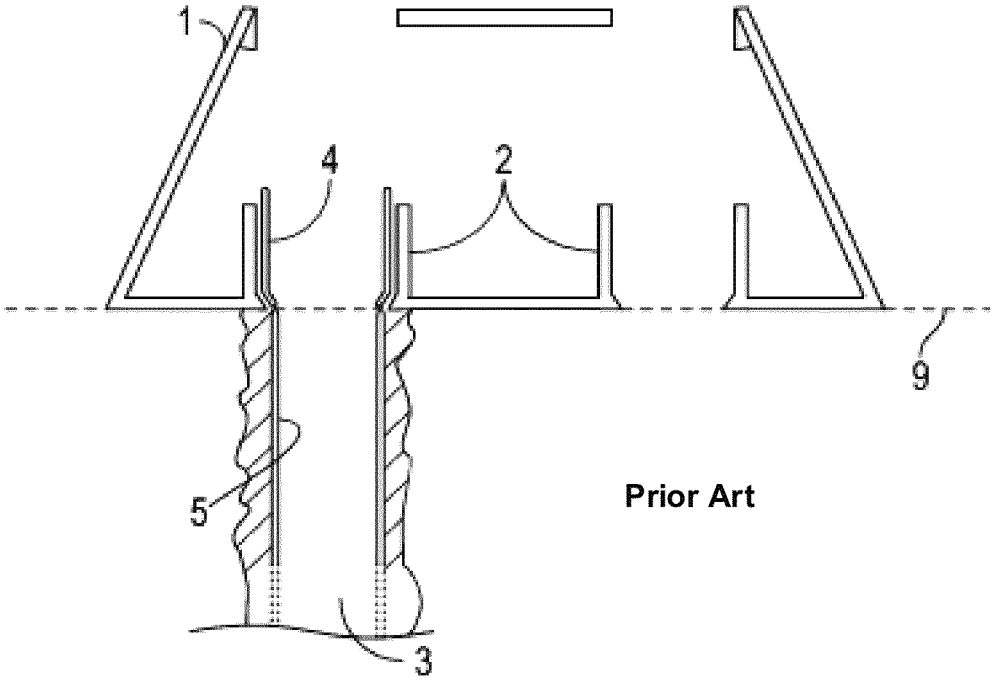
FIG. 1 is a diagrammatic view of a subsea template, conductor housing and conductor.

Examples and various features and advantageous details thereof are explained more fully with reference to the exemplary, and therefore non-limiting, examples illustrated in the accompanying drawings and detailed in the following description. Descriptions of known starting materials and processes can be omitted so as not to unnecessarily obscure the disclosure in detail. It should be understood, however, that the detailed description and the specific examples, while indicating the preferred examples, are given by way of illustration only and not by way of limitation. Various substitutions, modifications, additions and/or rearrangements within the spirit and/or scope of the underlying inventive concept will become apparent to those skilled in the art from this disclosure.

I. Terminology

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only those elements but can include other elements not expressly listed or inherent to such process, process, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The term substantially, as used herein, is defined to be essentially conforming to the particular dimension, shape or other word that substantially modifies, such that the component need not be exact. For example, substantially cylindrical means that the object resembles a cylinder, but can have one or more deviations from a true cylinder.

Additionally, any examples or illustrations given herein are not to be regarded in any way as restrictions on, limits to, or express definitions of, any term or terms with which they are utilized. Instead these examples or illustrations are to be regarded as being described with respect to one particular example and as illustrative only. Those of ordinary skill in the art will appreciate that any term or terms with which these examples or illustrations are utilized encompass other examples as well as implementations and adaptations thereof which can or cannot be given therewith or elsewhere in the specification and all such examples are intended to be included within the scope of that term or terms. Language designating such non-limiting examples and illustrations includes, but is not limited to: "for example," "for instance," "e.g.," "In some examples," and the like.

As referred to herein, the term "conductor" refers to an outer steel tubing operable to take lateral loads, support the bore and protect the casing, while not designed to take an internal pressure. The term "casing" refers to tubing having a higher spec than conductor and designed to take an internal pressure. The term "slot" refers to an aperture in a template allowing a drill string to be passed therethrough and being surrounded by an upstanding structure, which can be operable to receive the conductor housing. In at least one instances, the upstanding structure is substantially cylindrical.

Although the terms first, second, etc. can be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed a second element, component, region, layer or section without departing from the teachings of the present inventive concept.

II. General Architecture

The present inventive concept is drawn to a system and method for creating a subsea well, including installing a conductor housing within a template on a surface of the earth, for example a seafloor. The template can have one or more template slots formed therein and operable to receive a conductor housing therein. The template slot and conductor housing can have a longitudinal bore formed there through exposing at least a portion of the surface on which the template is placed. A drill string can be passed through the conductor housing and the template slot to form a borehole in the surface of the earth and through a subterranean formation below. A surface casing can then be installed within the borehole and a wellhead housing can be mounted in the conductor housing, e.g. by being placed on a mounting ring and supported in at least part by an internal shoulder of the conductor housing. In some instances, the template slot and/or slots can have no conductor housing installed therein. In this instance, the wellhead housing can be mounted in the template slot.

A bottom surface of the template can be engaged with the surface of the earth and the surface casing can extend through the conductor housing through the borehole and into the subterranean formation.

The conductor housing and the template can be assembled prior to placement on the surface of the earth.

In at least one instance, the template can have a plurality of template slots formed therein. The plurality of template slots can have bracing arranged therebetween allowing lateral load transfer between each of the plurality of template slots.

FIG. 1 illustrates a subsea template arrangement. A template (i.e. drilling guide) 1 is operable to be installed on a surface 9 through which a bore 3 is desired to be formed. In at least one instance, the template 1 can be installed on a seafloor surface 9. The template 1 can have a plurality of template slots (referred to as guide slots and/or slots) 2 formed therein. The slots 2 can form a longitudinal bore therethrough exposing at least a portion of the surface 9.

The template 1 requires a drill string to be passed through the slot 2 to form a large diameter bore 3 in the surface 9 (i.e. seafloor) subterranean rock. The large diameter bore 3 is approximately ninety (90) centimeters (cm) to one hundred and seven (117) cm in diameter (36-46 in. in diameter). The large diameter bore 3 can be formed to extend approximately seventy 70 meters (m) into the subterranean formation before the drill string is removed from the bore and withdrawn from the slot 2. A conductor housing 4 and conductor 5 can be welded together and then the conductor housing and conductor passed together through the template slot 2. The conductor housing is installed in the template slot 2. The conductor housing 4 may have an outer diameter of 96 to 152 cm, typically about 111 cm (44 in) and conductor 5 can have an outer diameter of 66 to 107 cm, typically about 76 cm (30 in).

The conductor housing 4 and the conductor 5 can be substantially cylindrical longitudinally extending tubes and installed within the template 1 and longitudinally align with the large diameter bore 3. The conductor housing 4 is installed in the guide slot 2 and the conductor 5 extends below the drilling guide 1 and into the large diameter bore 3 and thus into the subterranean formation. A drill string is then reinserted into to the bore 3 to drill through the conductor 5 forming a smaller diameter bore (relative to the large diameter bore 3). The smaller diameter bore begins at approximately 70 m or so below the seafloor at the termination of the large diameter bore 3.

Figure 2:
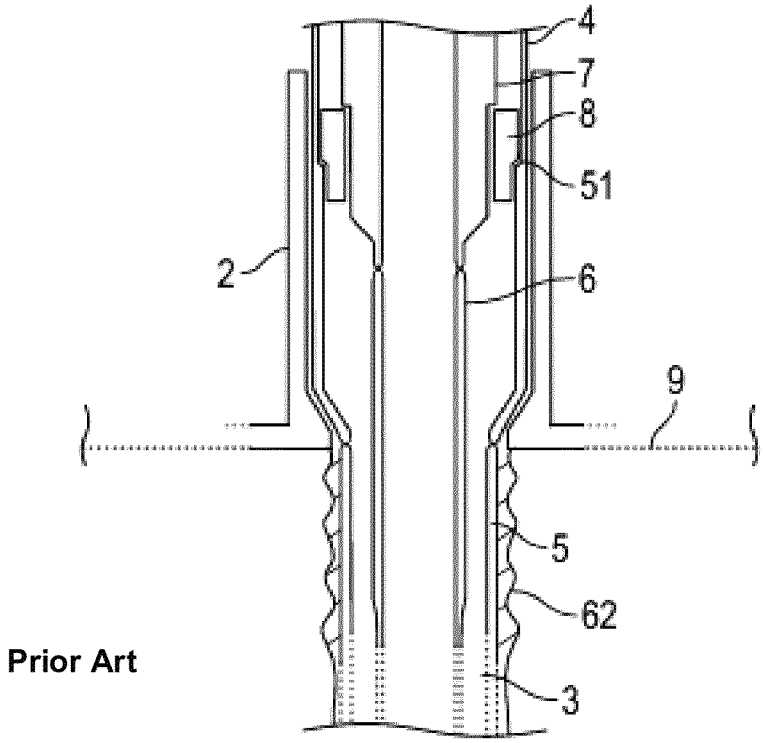
FIG. 2 is a diagrammatic cross-section view of a subsea template conductor housing and conductor, with a wellhead housing and surface casing installed.

FIG. 2 illustrates a diagrammatic cross-section view of a portion of a template arrangement, showing one slot, a conductor housing welded to conductor, a wellhead housing and surface casing. Surface casing 6 is passed through an internal bore of the conductor 4, which is installed in a large diameter bore in the seafloor. The surface casing 6 is passed down through the conductor 5 and enters the smaller diameter bore drilled into rock where the large diameter bore 3 (and the conductor 5) terminates. In at least one instance, the surface casing 6 is approximately fifty (50) cm to fifty-six (56) cm in diameter (approximately 20 to 22 in. in diameter).

A wellhead housing 7 coupled with the surface casing 6 can then be installed within the conductor housing 4. The wellhead housing 7 can engage and align within the conductor housing 4 via a mounting ring 8. The mounting ring 8 can be engaged and/or supported on an internal shoulder 51 of the conductor housing 4.

The template assembly 1 requires assembly on the seafloor. Further, the use of a conductor housing 4 and a conductor 5 requires the removal of the drill string from the bore hole 3 to allow insertion of the conductor housing 4 and conductor 5 followed by reinsertion of the drill string.

Figure 3:
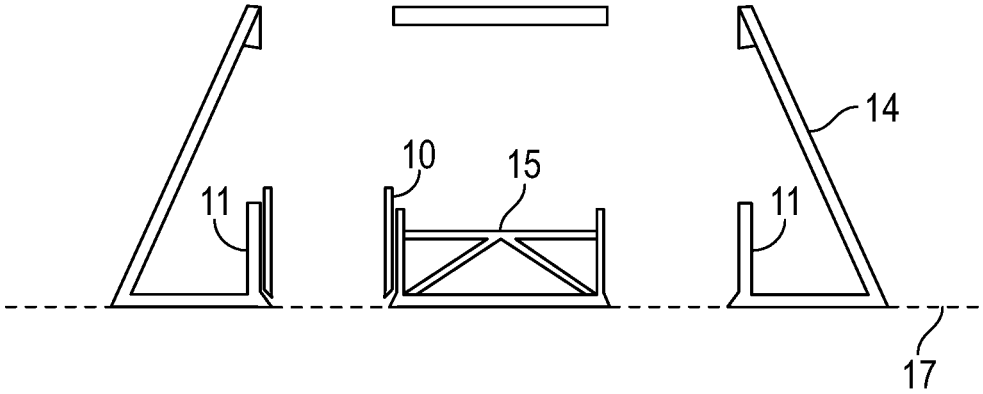
FIG. 3 is a diagrammatic view of a subsea template and conductor housing, according to at least one instance of the present inventive concept.

FIG. 3 illustrates a template assembly, according to at least one instance of the present inventive concept. A template 14 can be operably placed on a surface (e.g. seafloor 17) through which a bore is desirable to be formed.

The template 14 can be have a plurality of template slots 11 formed therein, each template slot operably exposing at least a portion of the surface 17. A conductor housing 10 can be installed within one or more of the plurality of template slots 11. The template can have between 2 and 10 template slots 11, optionally 2 to 4 template slots 11. Each template slot 11 can operably receive a conductor housing 10 therein.

In at least one instance, the conductor housing 10 can be welded or otherwise fusibly engaged with at least one of the plurality of template slots 11. In other instances, the conductor housing 10 is installed in, but not welded or otherwise fusibly engaged with one or more of the plurality of template slots 11.

Assembly of the conductor housing 10 and template 14 can be performed on land and/or after placement of the template 14 on the seafloor 17. After assembly, a drill string can then be passed through the conductor housing 10 and the template slot 11 to form a bore 18 within the surface 17.

Figure 4:
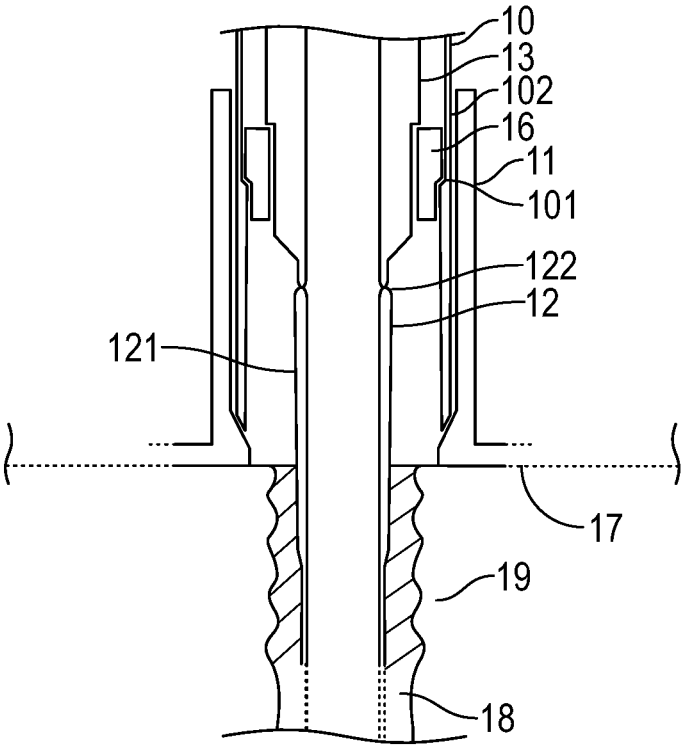
FIG. 4 is a diagrammatic cross-section view of a subsea template and conductor housing, with a wellhead housing and surface casing installed, according to at least one instance of the present inventive concept.

FIG. 4 illustrates a diagrammatic cross-section view of a template well slot assembly, according to at least one instance of the present inventive concept. The bore 18 is sized to receive a surface casing 12. The bore 18 can be narrower than the large diameter bore (as described with respect to FIG. 1). The bore 18 can then receive a surface casing 12 therein. In at least one instance, the surface casing can be welded to a wellhead housing 13 installed within the conductor housing 10. The surface casing may be cemented in the bore with cement 19.

The surface casing 12 can have a diameter and wall thickness sufficient to provide strength together with the wellhead housing 13 to withstand expected axial, lateral, bending and fatigue loads on it. Most loads act initially on the riser and these are in the main transferred to the wellhead housing. These loads then transfer to the surface casing, and from there to the conductor housing (if present). Loads act during installation of the well and also during its lifetime.

The surface casing 12 can be coupled with a wellhead housing 13. The wellhead housing 13 can engage with a mounting ring 16 supported on an internal shoulder 101 of the conductor housing 10. In at least one instance, the surface casing 12 can be approximately fifty (50) cm to fifty-six (56) cm in diameter (approximately 20 to 22 in. in diameter). In other instances, the surface casing 12 can have an outer diameter between 40 centimeters (cm) and 66 cm, preferably between 50 cm and 61 cm.

In at least one instance, the surface casing 12 can have an upper portion 121 having a larger outer diameter (OD). The upper portion 121 can be engaged with the wellhead housing 13, the larger OD providing increased strength. The larger OD can be approximately 61 cm (24 in).

The conductor housing 10 and the template slot 11 can have a reduced tolerance therebetween, thus reducing the annulus 102 formed between the conductor housing 10 and the template 11. In at least one instance, the tolerance between the template slot and the respective conductor housing can be between 0.2 millimeters (mm) and 1.0 mm, preferably between 0.4 and 0.8 mm, e.g. between 0.5 and 0.7 mm.

The reduced tolerance, and thus reduced annulus 102, can allow improved transfer of loads, including lateral loads between the conductor housing 10 and the template slot 11. This helps prevent excessive axial, lateral, bending, circumferential or catastrophic fatigue loads from being transferred, e.g. to the weak point 122 between wellhead housing 13 and the surface casing 12. A lateral load can be any force or load substantially perpendicular to the direction of the bore 18 and/or substantially parallel to the seafloor, acting on the riser and transferred to the template.

In at least one instance, the conductor housing 10 and template 14 can be assembled prior to placement on the surface 17, thus allowing the reduced tolerance as the conductor housing 10 are not be seated within the template slot 11 while in place on the surface, such as a seafloor. The assembly onshore is made possible by the lack of a conductor meaning the template assembly has a substantially flat bottom surface engaged with the surface 17 of the earth.

In other instances, the conductor housing 10 can be installed within the template slot 11 after installation of the template 14 on the surface of the earth.

In at least one instance, the template 14 can have bracing 15 disposed between the one or more template slots 11 allowing lateral load transfer between each of the one or more template slots 11.

The template assembly described with respect to FIGS. 3 and 4 can eliminate the need to drill a large diameter borehole followed by removal of the drill string and insertion of a conductor and then reinsertion of the drill string to form continuation of the borehole at a smaller diameter.

Figure 5:
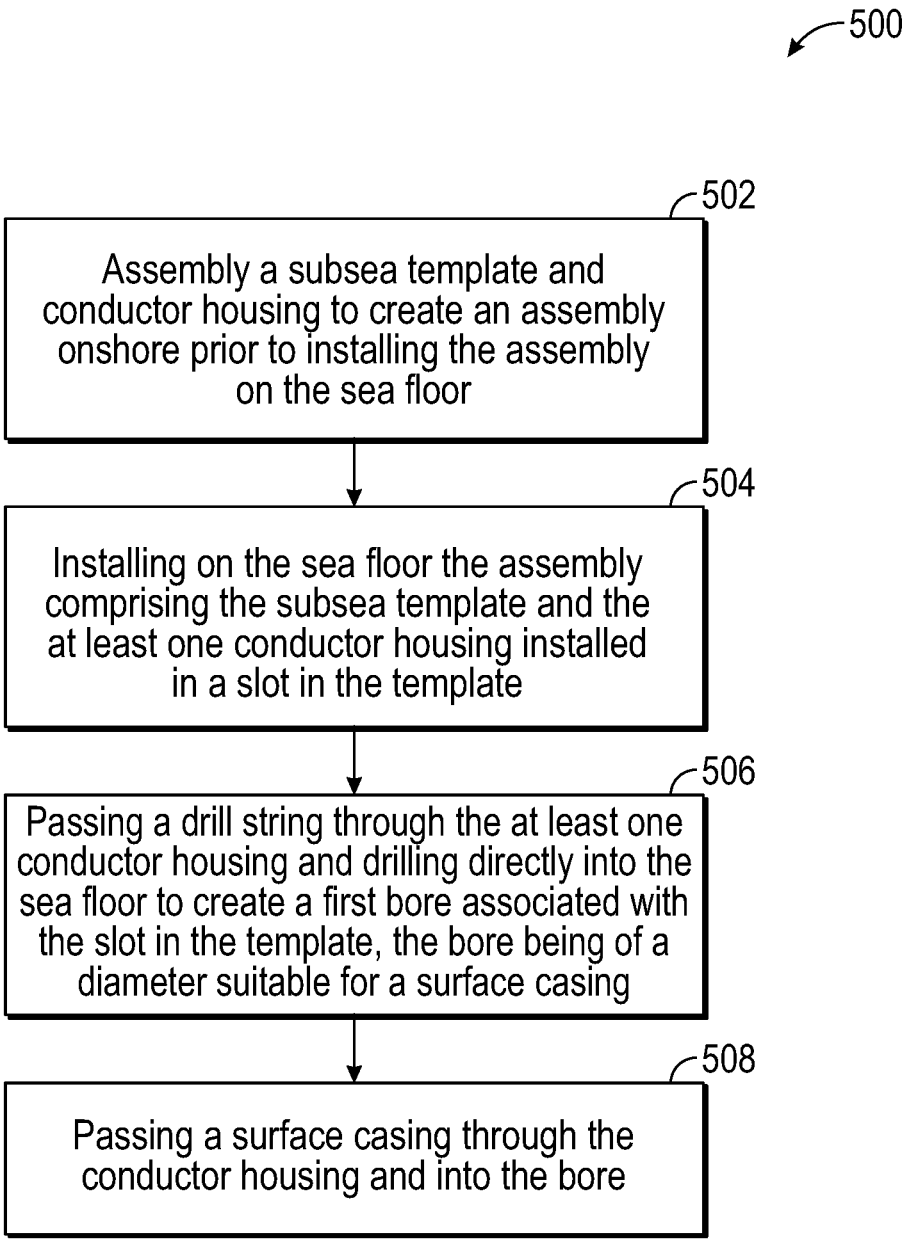
FIG. 5 is a block diagram of a method for creating a wellbore with an assembly of FIGS. 3 and 4.

FIG. 5 illustrates a block diagram detailing a method for use with the template assembly, according to at least one instance of the present inventive concept. While the method of FIG. 5 is shown and described with respect to blocks 502-508, it is within the scope of this disclosure to implement any number of blocks, including omission of one or more blocks of method 500 or inclusion of additional blocks not specifically described with respect to method 500. Further, while blocks 502 are described sequentially, no specific order is implied nor required. Method 500 can begin at block 502.

At block 502, a template and a conductor housing can be assembled to create a template assembly onshore.

At block 504, the template assembly can be installed on a surface of the earth. The template assembly can include a template and at least one conductor housing installed in a slot in the template.

At block 506, a drill string can be passed through the conductor housing and drilling directly into the surface of the earth to create the first bore associated with the template slot. The bore can be of a diameter suitable for a surface casing.

At block 508, a surface casing can be passed through the conductor housing and into the bore.

In a modified instance, the conductor housing 10 can be omitted entirely. In this modified instance, the wellhead 13 and mounting ring 16 are mounted directly on an internal shoulder formed in the template slot, equivalent to the shoulder 101 in FIG. 4. In other respects the modified instance functions in the same way. With no conductor housing, there is no need for a pre-assembly step onshore to assemble a conductor housing to the template. Therefore, block 502 in FIG. 5 would be omitted in the modified embodiment.

While preferred examples of the present inventive concept have been shown and described herein, it will be obvious to those skilled in the art that such examples are provided by way of example only. Numerous variations, changes, and substitutions will now occur to those skilled in the art without departing from the disclosure. It should be understood that various alternatives to the examples of the disclosure described herein can be employed in practicing the disclosure. It is intended that the following claims define the scope of the disclosure and that methods and structures within the scope of these claims and their equivalents be covered thereby.

What is claimed is:

1. A method of creating a subsea well for production or injection of hydrocarbons, liquids or gases, the method comprising:

installing on a seafloor an assembly comprising a subsea template having a template slot;

passing a drill string through the template slot;

creating a bore associated with the template slot by drilling directly into the seafloor, the bore having a diameter corresponding to a surface casing;

passing the surface casing connected to a wellhead housing through the template slot and into the bore; and landing and locking the wellhead housing in the template slot, one or more loads on the wellhead housing being transferred to at least one of the subsea template or the surface casing.

2. The method of claim 1, wherein the assembly further comprises a conductor housing installed in the template slot, and wherein the drill string and surface casing are passed through the conductor housing in the template slot.

3. The method of claim 2, further comprising assembling the subsea template and the conductor housing to create the assembly onshore prior to installing the assembly on the seafloor.

4. The method of claim 2, wherein the subsea template is installed on the seafloor and the conductor housing is installed in the template slot when the subsea template is on the seafloor.

5. The method of claim 2, wherein the one or more loads includes at least one of axial, lateral, bending, or fatigue, and wherein the surface casing is welded to the wellhead housing installed within the conductor housing and wherein the surface casing has a diameter and a wall thickness reinforcing the wellhead housing to withstand the one or more loads during installation and life of the well.

6. The method of claim 5, wherein the diameter of the surface casing includes an outer diameter between 40 centimeters (cm) and 66 cm.

7. The method of claim 2, wherein the surface casing is not welded to the conductor housing.

8. The method of claim 1, wherein the assembly includes a plurality of conductor housings mounted to the subsea template in a corresponding plurality of template slots.

9. The method of claim 8, wherein a plurality of wellhead housings is installed in the plurality of conductor housings, the plurality of wellhead housings including the wellhead housing, wherein loads acting on one wellhead housing and the respective conductor housing are transferred to another of the plurality of conductor housings through the plurality of slots and the subsea template.

10. A system for creating a subsea well for production or injection of hydrocarbons, liquids or gases, the system comprising:

a subsea assembly configured for installation on a seafloor, the subsea assembly including a subsea template;

a template slot of the subsea template, the template slot configured for passage of a drill string and a surface casing connected to a wellhead housing into a bore drilled in the seafloor; and a conductor housing installed in the template slot, the conductor housing configured for passage of the drill string and the surface casing and wherein no conductor is welded or otherwise joined to the conductor housing, one or more loads on the conductor housing being transferred to at least one of the subsea template or the surface casing.

11. The system of claim 10, wherein the subsea assembly is configured for installation on the seafloor as an integral unit.

12. The system of claim 10, wherein the subsea template includes a plurality of conductor housings including the conductor housing and a plurality of template slots including the template slot, each conductor housing of the plurality of conductor housings installed in a respective slot of the plurality of template slots.

13. The system of claim 12, wherein a tolerance of a fit between each template slot of the plurality of template slots and a respective conductor housing of the plurality of conductor housings is between 0.2 millimeters (mm) and 1.0 mm.

14. The system of claim 12, wherein a bracing structure is provided between one or more template slots of the plurality of template slots to allow loads on one template slot to be shared with one or more other template slots of the plurality of template slots.

15. The system of claim 12, wherein a number of the plurality of conductor housings is between two and ten.

16. The system of claim 10, wherein an outer diameter of the conductor housing is between 96 and 127 cm.

17. The system of claim 10, wherein the conductor housing is configured for installation in the template slot when the subsea template is installed on the seafloor.

18. The system of claim 10, wherein the surface casing has a diameter corresponding to the bore.

19. The system of claim 10, wherein the subsea template and the conductor housing are configured for assembly onshore prior to the installation of the subsea assembly on the seafloor.

20. The system of claim 10, wherein the surface casing is welded to the wellhead housing.

* * * * *